US005813688A

United States Patent [19]

Dacklin

[11] Patent Number: 5,813,688

[45] Date of Patent: Sep. 29, 1998

[54] SNOWBOARD BINDING

[75] Inventor: Kib Dacklin, Salt Lake City, Utah

[73] Assignee: Steven Beck, Costa Mesa, Calif.

[21] Appl. No.: 164,213

[22] Filed: Dec. 8, 1993

[51] Int. Cl.[6] ..... A63C 9/08

[52] U.S. Cl. ..... 280/607; 280/14.2

[58] Field of Search ..... 280/607, 617, 280/618, 619, 14.2, 633, 623, 625, 626

[56] References Cited

U.S. PATENT DOCUMENTS

| | | | |
|---|---|---|---|
| Re. 33,544 | 2/1991 | Dennis | 280/14.2 |
| 3,685,846 | 8/1972 | Schmid . | |
| 3,817,543 | 6/1974 | Haff | 280/607 |
| 3,854,738 | 12/1974 | Fish . | |
| 3,974,049 | 8/1976 | Pedersen . | |
| 4,592,568 | 6/1986 | Priskich . | |
| 4,779,890 | 10/1988 | Mugnier . | |
| 4,792,155 | 12/1988 | Besnier . | |
| 4,844,502 | 7/1989 | Besnier . | |
| 4,856,808 | 8/1989 | Longoni | 280/617 |
| 4,973,073 | 11/1990 | Raines et al. . | |
| 5,054,807 | 10/1991 | Fauvet . | |
| 5,096,217 | 3/1992 | Hunter . | |
| 5,156,644 | 10/1992 | Koehler et al. . | |

FOREIGN PATENT DOCUMENTS

| | | | |
|---|---|---|---|
| 0270175 | 6/1988 | European Pat. Off. | 280/14.2 |
| 3818569 | 4/1989 | Germany | 280/14.2 |

*Primary Examiner*—Richard M. Camby
*Attorney, Agent, or Firm*—Klarquist Sparkman Campbell Leigh & Whinston, LLP

[57] ABSTRACT

A snowboard binding is disclosed having a mounting frame for rigid attachment to a snowboard. The frame has upstanding opposite end portions between which a rocker plate is mounted on a shaft for rocking movement about a rocker axis generally parallel to the top surface of a snowboard and the longitudinal axis of a boot mounted in the binding. The rocker plate carries a bail for securing a boot to the binding. Elastomeric blocks on opposite sides of the mounting frame engage the underside of the rocker plate on opposite sides of the rocker axis to control and limit the extent of rocking movement permitted about the rocker axis. Two such bindings mount each boot, one at the toe and the other at the heel, to a snowboard, with the rocker axes of the two bindings coincident.

21 Claims, 2 Drawing Sheets

SNOWBOARD BINDING

TECHNICAL FIELD

The present invention is directed to a snowboard binding for mounting a boot onto a snowboard.

BACKGROUND INFORMATION

Snowboarding has risen in popularity in recent years. A snowboard includes a single, relatively wide board that is highly maneuverable. The snowboard is provided with bindings for mounting a pair of boots. The boots are often mounted diagonally across the snowboard so that the snowboarder is positioned on the snowboard much like a surfer positions his- or herself on a surfboard.

The high maneuverability of the snowboard yields substantial forces on the bindings when a snowboard user undertakes high-performance turns and the like. Thus, as the popularity of snowboarding has grown, so has the need for more refined snowboard bindings. Many snowboard bindings simply anchor the boots rigidly on to the snowboard. While such rigid bindings perform adequately, the rigidity may cause a user to lose control of the snowboard during aggressive snowboarding.

Snowboard bindings with built-in resiliency are an improvement over rigid bindings. The resiliency in such bindings provides some shock-absorbing "give" in the binding when the snowboard user undertakes a high-stress turn or flip. Thus, such shock absorption provides a user with an added margin of snowboard control when undertaking high-performance snowboarding.

Known resilient snowboard bindings, however, have a disadvantage in that the binding is mounted to the board with a pad of resilient material between the binding and the board. Thus, the binding is free to deflect the resilient material in any direction during snowboarding. Such freedom of movement may result in the binding providing sloppy performance during snowboarding.

SUMMARY OF THE INVENTION

The primary object of the present invention is to provide an improved resilient binding for a snowboard.

A further object of the invention is to provide a snowboard binding allowing resilient movement in selected directions while providing rigidity in other directions.

Another object of the invention is to provide a snowboard binding that is of a simple and tough design.

The snowboard binding comprises a frame rigidly attached to a snowboard. A rocker plate is connected to the frame for rocking movement about a rocker axis. A boot is mountable on top of the rocker plate and held in position by bails and a clamp carried by the rocker plate. A rocker regulator engages the rocker plate to control rocking movement of the rocker plate.

In a preferred embodiment, the regulator comprises a pair of resilient elastomeric blocks, one beneath each of the opposite sides of the rocker plate. The blocks urge the rocker plate to a neutral position, and loading and unloading of the rocker plate by the snowboarder causes the plate and boot to rock laterally from side-to-side within limits determined by the resilience of the blocks. Two bindings support each boot, one at the toe and another at the heel. The bindings are mounted one behind the other so that their rocker axes are coincident. Two pairs of bindings are mounted on a snowboard, one pair for each boot. The axes of the two pairs are usually parallel when mounted, and oblique to the longitudinal axis of the snowboard.

DESCRIPTION OF A PREFERRED EMBODIMENT

Figure 1:
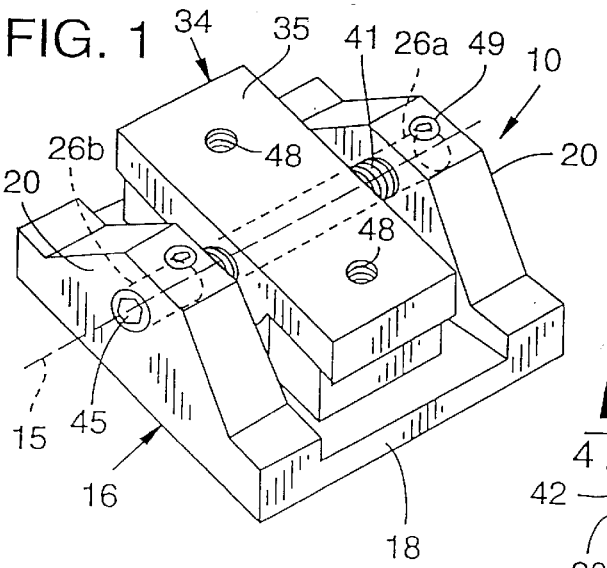
FIG. 1 is a perspective view of a snowboard binding (without bail) in accordance with an embodiment of the present invention.
Figure 5:
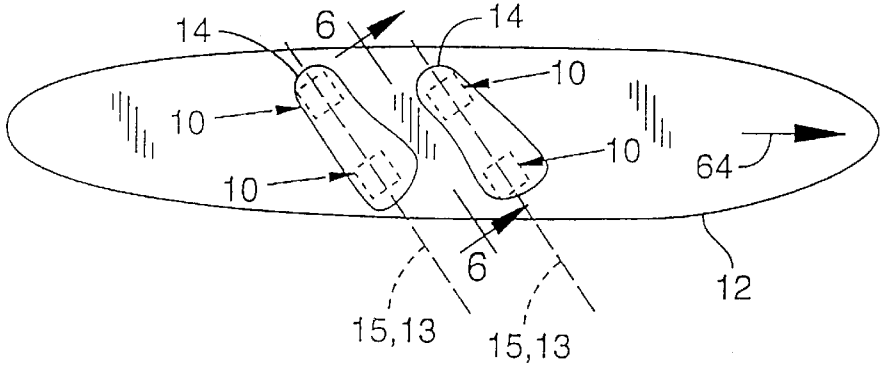
FIG. 5 is a top plan view of a snowboard showing schematically the locations of a pair of boots and (in phantom) two pairs of snowboard bindings in accordance with the present invention.

A snowboard binding 10 in accordance with a preferred embodiment of the invention is shown in FIG. 1. As shown in FIG. 5, two pairs of snowboard bindings (binding units) 10 are mounted on a snowboard 12. A boot 14 is mounted in each pair of snowboard bindings 10 (see FIGS. 5 and 6). The bindings 10 permit the snowboarder to resiliently rock his or her boots 14 a few degrees about a rocker axis 15 that is parallel to the longitudinal axis 13 of the boots 14. The rocking action is regulated to provide for improved control during snowboarding. In the following discussion of a preferred embodiment, the construction of the bindings 10 will first be described, followed by a description of the operation of the bindings in the snowboarding environment.

Figure 6:
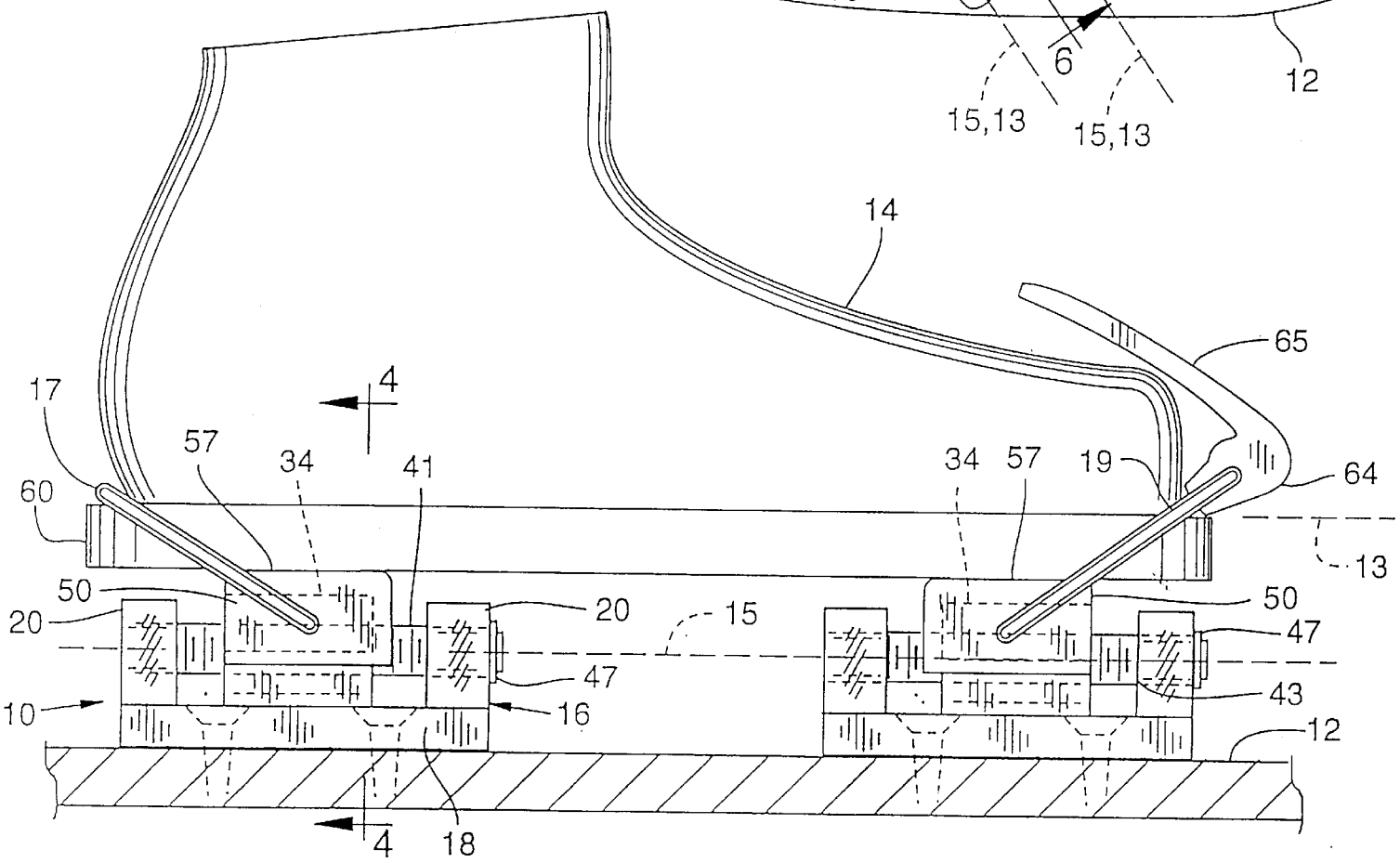
FIG. 6 is a sectional view through a midsection of a snowboard taken along the line 6—6 of FIG. 5 showing a pair of the bindings of FIG. 1 in elevation (with bails and clamp added) mounted on the snowboard and mounting a boot.

As shown in FIG. 6, the heel and toe of each boot 14 is respectively mounted in a pair of substantially identical bindings 10. In a preferred embodiment, the bindings 10 supporting the boot 14 heel and toe differ only in the design of the bails 17, 19 for holding the boot heel and toe, respectively. Therefore, the following description of a single binding applies equally well to either the heel or toe binding.

As shown in FIGS. 1 and 6, the snowboard binding 10 includes a mounting frame 16. From the side, the frame 16 is U-shaped, with the base of the U being a base plate 18, and the opposed legs of the U being a pair of upstanding spaced-apart rocker support plates or portions 20. The base plate 18 is provided with mounting screw apertures 22 for mounting the binding 10 rigidly to a snowboard 12 (see FIG. 4) with mounting screws 23.

Figure 3:
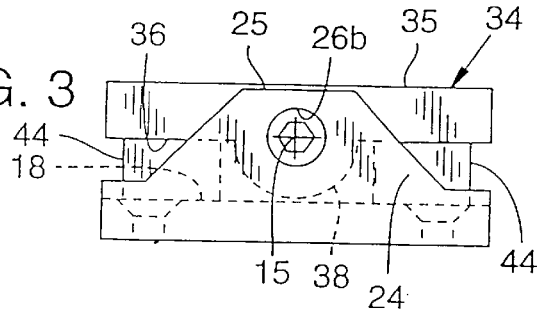
FIG. 3 is an end view of the snowboard binding of FIG. 1.

As shown in FIG. 3, each rocker support plate 20 has a base portion 24 that extends substantially along the entire width of frame base plate 18. The rocker support plate 20 narrows with elevation to a plate top portion 25 centrally located above the base plate 18. A shaft aperture 26*a*, 26*b* extends through an upper portion of each rocker support plates 20. Apertures 26*a*, 26*b* of the two rocker support plates 20 are longitudinally aligned to receive a rocker shaft 41 and define a rocker axis 15. As will be discussed below, a snowboard boot mounted to a pair of the present bindings 10 is rockable about the rocker axis 15.

A rocker plate 34 (for rockably supporting the boot 14) is mounted between the opposed rocker support plates 20 on shaft 41 for rocking movement about rocker axis 15. The rocker plate 34 is a rectangular block, with a length substantially equal to the side-to-side width of frame 16. Rocker plate 34 has a width such that a gap exists between the rocker plate side edges 42 and the inside faces of rocker support plates 20 (see FIG. 2). The plate 34 has an upper surface 35, a lower surface 36, and an arcuate ridge 38 running centrally from side-to-side across the lower surface 36. A cylindrical bore 40 (see FIG. 4) concentric with arcuate ridge 38 extends through the rocker plate 34 to receive shaft 41.

Figure 2:
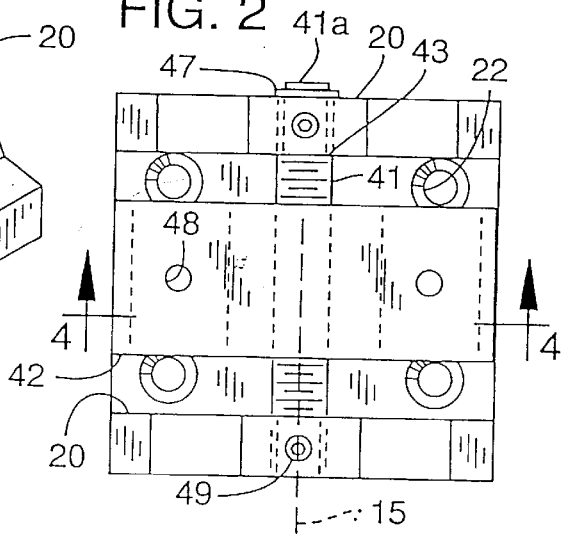
FIG. 2 is a top plan view of the snowboard binding of FIG. 1.

In a preferred embodiment, the rocker shaft 41 is threaded and has a shoulder 43 leading to a non-threaded, reduced diameter end 41*a* (see FIG.2). Shaft 41 is axially slidable through shaft aperture 26*b*. The rocker plate bore 40 is threaded so that the rocker shaft 41 may be threaded therethrough. To facilitate this threading, the opposite end of the rocker shaft 41 may be provided with a key-wrench aperture 45 (see FIG. 1). The rocker shaft 41 may be lubricated to facilitate the threading of the shaft 41, and to promote a smooth rocking motion. The shaft is threaded through the rocker plate 34 until the reduced diameter shaft end 41*a* is fully received within shaft aperture 26*a*. Shaft aperture 26*a* is of a like reduced diameter to receive the reduced diameter end 41*a* of the shaft, but not the shaft threads. Thus, the shaft shoulder 43 abuts against the rocker support plate 20 inner face to prevent further axial movement of the shaft 41. Shaft 41 may be axially locked by fastening a lock washer 47 over a portion of the reduced diameter shaft end 41*a* that protrudes from aperture 26*a* over the outer face of the rocker support plate 20 (see FIG. 2).

Once the shaft 41 is so positioned, the shaft 41 may be rotated to thread the rocker plate 34 into a desired fore-aft position on the shaft 41. The desired rocker plate 34 position may be determined by boot size, and the distance between a pair of bindings 10 on the snowboard 12 (see FIG. 6).

Once the rocker plate is positioned as desired, rocker shaft 41 is rigidly fixed against rotation within the shaft apertures 26*a*, 26*b*. A set screw 49 extends through each rocker support plate top portion 25 into engagement with the rocker shaft 41. It is to be understood that other means of rigidly fixing rocker shaft 41 within apertures 26*a*, 26*b*, such as lock nuts, will work equally as well. In fact, shaft 41 may work as well if only axially (but not rotatably) secured within apertures 26*a*, 26*b*.

Figure 4:
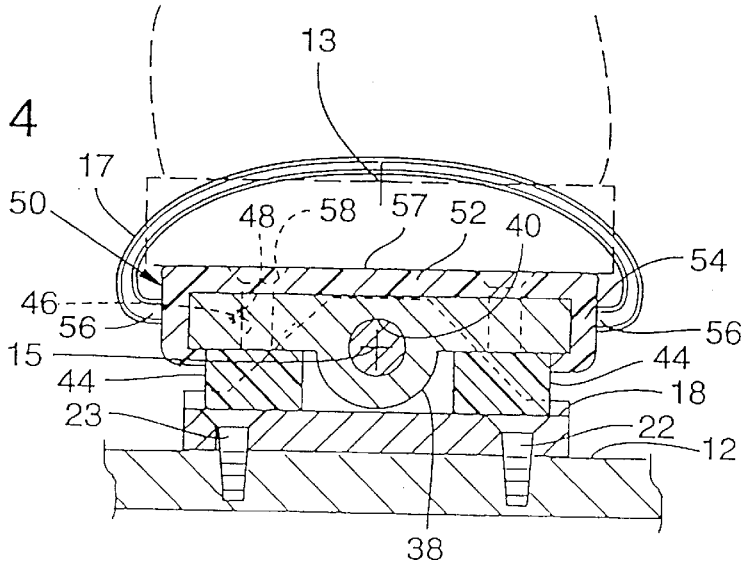
FIG. 4 is a cross-sectional view taken along line 4—4 of FIG. 2, also showing a bail for attaching a boot (in phantom) to the binding.

As best seen in FIG. 3, the rocker plate 34 is supported upon the rocker shaft 41 at an elevation such that the rocker plate lower surface 36 is elevated above the frame base plate 18. A rocker regulator interconnects the rocker plate lower surface 36 and the frame base plate 18 to regulate the rocking of the rocker plate 34 about the rocker axis 15. As shown in FIGS. 3 and 4, the rocker regulator preferably comprises two blocks 44 of resilient material. The resilient blocks 44 are snugly fitted between the rocker plate lower surface 36 and the frame base plate 18 on either side of the central arcuate ridge 38 to bias the rocker plate to a neutral position relative to base plate 18 and the top surface of snowboard 12. In this neutral position, the rocker plate is generally parallel to the base plate and snowboard surface. The resilient blocks may be slightly precompressed when installed. Block precompression helps prevent the blocks from becoming loose, and firmly sets the rocker plate 34 upon the rocker shaft 41. The result is a smooth resilient rocking action of the rocker plate 34 upon the shaft 41, without looseness or sloppiness.

The resilient blocks 44 are preferably positively attached to the rocker plate lower surface 36 by a pair of block screws 46 (See FIG. 4). The rocker plate 34 has a threaded block screw aperture 48 that aligns with a center portion of each resilient block 44. The block screws 46 thread through the block screw apertures 48 and extend into the respective resilient block 44. It is to be understood that the resilient blocks 44 could be positively attached to the base plate 18, or the rocker support plates 20, with equally good results.

A hard plastic (or metallic) sleeve-like boot mounting plate 50 fits snugly over and covers rocker plate 34. As shown in FIG. 4, boot mounting plate 50 has an inverted U-shape with a broad base 52 for receiving a boot sole, a pair of opposed, downwardly extending legs 54 that cover the end surfaces of the rocker plate, and inwardly projecting flanges 56 that grip the lower surface 36 of the rocker plate to retain the boot mounting plate on the rocker plate 34. Mounting plate base 52 has a smooth, low-friction upper surface 57 for receiving a sole portion of boot 14.

A pair of screw head apertures 58 through mounting plate base 52 align with block screw apertures 48 in rocker plate 34. The block screws 46 (described above) thread through the aligned block screw and screw head apertures 48, 58 to secure boot mounting plate 50 to rocker plate 34.

The interrelation of each pair of bindings 10 supporting a boot 14 will now be described. As shown in FIG. 6, a pair of bindings 10 (binding units) are mounted onto a snowboard 12 in a front and a rear position to support the boot 14 at the toe and heel, respectively. The rocker axes 15 of the front and rear bindings 10 are in alignment, or coincident with, one another. The pairs of resilient blocks 44 of both bindings are preferably identically configured so that the rocker plates 34 normally have a preselected neutral orientation parallel to base plate 18 and snowboard 12. Such a neutral rocker plate position normally locates the boots 14 of a snowboarder in a neutral position parallel to the top surface of snowboard 12.

A heel bail 17 and a toe bail 19 are pivotally attached to the outside of boot mounting plate legs 54. The bails 17, 19 securely attach boot 14 to the respective front and rear bindings 10 (see FIG. 6). The heel bail 17 extends diagonally upward (and aft) from rear binding mounting plate 50 to fit over a protruding heel block 60 of boot 14. The toe bail 19 extends diagonally upward (and forward) from front binding mounting plate 50 to fit over a protruding toe block 62 of boot 14. The toe bail 19 pivotally mounts a lever-operated cam 64 that, when rotated clockwise by lever 65, cams boot sole 60 against surface 57 of the mounting plate. At the same time, the cam urges the boot sole rearwardly against heel bail 17 to secure or clamp the boot against up-and-down, fore-and-aft, and lateral boot movement relative to the rocker plates 34. In effect, the boot and bindings act as a single entity with a single pivot axis.

As shown in FIG. 6, boot 14 has a longitudinal axis 13 extending lengthwise of the boot. The boot axis 13 extends parallel to the coincident rocker axes 15 when the boot 14 is mounted in the bindings 10. As described above, the sole of mounted boot 14 normally assumes a neutral boarding position generally parallel to the snowboard and frame base plate 18.

The two boots 14 are usually mounted diagonally across the snowboard 12, with the longitudinal axes 13 of the boots parallel. The boots can, however, be mounted in a variety of angles with respect to the snowboard. While the snowboard 12 generally travels in the direction of arrow 64 (see FIG. 5), the snowboard may travel in any direction, especially during turns or other maneuvers.

Operation

The bindings 10 as described permit a regulated amount of controlled rocker motion (preferably about a few degrees)

about rocker axis 15. A lateral loading (weighting) of boot 14 applies a torque to the rocker plates 34. The torque rocks the rocker plates about their axes out of their neutral positions. As a rocker plate 34 rocks, one of the resilient blocks is compressed to absorb force and limit rocker plate movement. Once the lateral loading of the boot is relieved, resilient block 44 rebounds, urging its rocker plate back into the neutral position.

Such loading and unloading (weighting and unweighting) occurs continually during aggressive snowboarding, such as during turns or jumps. During maneuvers, the inside blocks of one boot may be compressed while the outside blocks of the other boot are compressed. In any case, each pair of bindings can rock independently of the other pair on a snowboard, giving the snowboarder excellent control through changes in weight distribution and shock loading of the bindings.

The resilient blocks 44 of the present binding 10 may also damp high-frequency vibrations generated at the snowboard 12 during snowboarding. Thus, the binding 10 helps isolate the snowboard boot 14, and thus the snowboarder, from undesirable high-frequency vibrations. Minimizing high-frequency vibrations in the snowboard boot 14 helps reduce snowboarder fatigue, and enhances the control of the snowboarder over the snowboard.

The resilient blocks 44 preferably permit a few degrees or so of rocker plate 34 motion. Excellent results are obtained when the resilient blocks are made of an elastic urethane or the like with a hardness range of 60–100 durometer. The durometer may be varied depending on the age, weight and performance level of the snowboarder, with higher weight and performance levels generally requiring a higher durometer. For instance, relatively soft blocks 44 may be desirable for a novice snowboarder, while an expert may prefer very stiff blocks 44.

The resilient blocks 44, while preferably urethane, may be made of other plastic, composite, or rubber materials with equally good results. Coil spring members may also be integrated into the block to provide resilient regulation of the rocker plate 34 rocking. Moreover, the resilient blocks 44 may have a series of layers of differing resiliency, in order to achieve a desired composite resiliency. The shape and position of the resilient blocks 44 may also be varied. In general, as the block 44 support of the rocker plate 34 moves laterally outward, the block may be softer and still offer adequate resilient support. p Moreover, instead of being attached just to the rocker plate lower surface 36, the resilient blocks 44 may be positively attached to both the rocker plate lower surface 36, and the base plate 18. With such a dual attachment, the pair of resilient blocks 44 would be respectively compressed and stressed as the rocker plate 34 rocks in one direction about the rocker axis 15. The resilient biasing action toward the neutral position would therefore be more pronounced.

The illustrated preferred embodiment of the present binding 10 is advantageous in its simplicity. The binding has relatively few parts and can be easily assembled and disassembled. In this regard, the resilient blocks 44 can be easily replaced to suit the needs of a particular snowboarder. The simple, tough components of the binding are relatively invulnerable to wear and so offer a long service life with low maintenance costs.

This detailed description is set forth only for purposes of illustrating examples of the present invention and should not be considered to limit the scope of the invention in any way. Clearly, numerous additions, substitutions, and modifications can be made to these examples without departing from the scope of the invention which is defined by the appended claims and their equivalents.

I claim:

1. A binding for mounting a boot on a snowboard, comprising:

a mounting frame attachable to the snowboard comprising a U-shaped member defining a base plate and a pair of longitudinally spaced apart upright support portions along a single rocker axis;

a rocker plate supported by the frame and rockably mounted between the upright support portions and spaced above said base plate for rocking movement about the rocker axis and having an upper plate surface for supporting the boot; and a rocker regulator engaging the rocker plate to resist rocking movement of the rocker plate about the rocker axis wherein the rocker regulator comprises a pair of resilient blocks mounted on the base plate between the upright support portions and beneath opposite end portions of the rocker plate so as to bias the rocker plate to a neutral position generally parallel to the base plate when the rocker plate is unloaded.

2. A binding for mounting a boot on a snowboard, comprising:

a mounting frame attachable to the snowboard;

a rocker plate supported by the frame for rocking movement about a single rocker axis and having an upper plate surface for supporting the boot and a lower surface;

a resilient rocker regulator means snugly fitted between, and in constant engagement with, the lower surface of the rocker plate and the mounting fame for resisting rocking movement of the rocker plate in both directions about the rocker axis, the rocker regulator mean urging the rocker plate to a neutral position relative to the rocker plate.

3. A binding according to claim 1, including clamping means on the rocker plate for clamping a boot to the upper plate surface with a longitudinal axis of the boot parallel to the rocker axis so that the boot can rock from side-to-side.

4. A binding according to claim 1, wherein the rocker regulator means is positioned between the mounting frame and the rocker plate such that the rocker plate resiliently compresses the rocker regulator means when rocked from said neutral position.

5. A binding according to claim 1, wherein the mounting frame includes a pair of upstanding rocker plate support portions spaced apart along the length of the frame and a pivot shaft extending between the rocker support portions supporting the rocker plate for rocking movement about the rocker axis.

6. A binding according to claim 5, wherein the shaft is fixedly mounted to the rocker support portions.

7. A binding according to claim 5, wherein the rocker support portions extend upwardly from a base plate to support the rocker plate in spaced relation above the base plate, the rocker regulator means comprising a resilient member positioned between and engaging the rocker plate and the base plate on opposite sides of the shaft to determine a neutral position of the rocker plate.

8. A binding according to claim 1, wherein the rocker axis extends generally lengthwise of the boot.

9. A binding according to claim 1, wherein a pair of said bindings are mounted to the snowboard for each boot, the pair of bindings having front and rear positions and coincident rocker axes.

10. A binding according to claim 9, wherein:

the front binding includes a toe bail for fitting over a toe portion of the boot;

the rear binding includes a heel bail for fitting over a heel portion of the boot;

one of said bails including an associated clamping means cooperable with both bails for securing a boot against fore-and-aft movement, up-and-down movement, and lateral movement relative to the upper surfaces of the rocker plates.

11. A binding according to claim 1, further comprising:

a snowboard;

four bindings mounted on the snowboard, two of said bindings for receiving each boot of a snowboarder;

the bindings mounted on the snowboard in pairs, each pair including a front binding and a rear binding;

the rocker axes of the front and rear bindings being coincident; and the pairs of bindings mounted on the snowboard such that the rocker axes of the two pairs of bindings are parallel.

12. A binding according to claim 11, wherein the rocker axes are oblique to a longitudinal axis of the snowboard.

13. A binding according to claim 1, wherein the rocker axis is generally parallel to the top surface of the snowboard on which the binding is mounted.

14. A binding according to claim 1, wherein the rocker regulator means includes a pair of resilient members positioned between the rocker plate and the snowboard top surface and normally urging the rocker plate to the neutral unloaded position wherein the rocker plate extends generally parallel to the top surface of the snowboard.

15. A binding for mounting a boot on a snowboard, comprising:

a mounting frame attachable to the snowboard having a U-shaped member defining a base plate and a pair of longitudinally spaced apart upright support portions;

a rocker plate supported by the frame for rocking movement about a rocker axis and having an upper plate surface for supporting the boot, said upright support portions aligned along the rocker axis with the rocker plate rockably mounted between the upright support portions and spaced above said base plate;

a rocker regulator engaging the rocker plate to resist rocking movement of the rocker plate about the rocker axis, said rocker regulator having a pair of resilient blocks mounted on the base plate between the upright support portions and beneath opposite end portions of the rocker plate so as to bias the rocker plate to a neutral position generally parallel to the base plate when the rocker plate is unloaded, each said resilient block includes multiple vertically stacked layers of different predetermined resiliencies.

16. A binding for mounting a boot on a snowboard, comprising:

a mounting frame attachable to the snowboard and including a pair of upstanding rocker plate support portions spaced apart along the length of the frame;

a threaded pivot shaft extending between, and fixedly mounted to, the rocker support portions;

a rocker plate supported by the shaft and threadably mounted to the shaft for rocking movement about a single rocker axis and having an upper plate surface for supporting the boot;

a rocker regulator engaging the rocker plate to resist rocking movement of the rocker plate about the rocker axis.

17. A binding for mounting a boot on a snowboard, comprising:

a mounting frame attachable to the snowboard comprising a U-shaped member defining a base plate and a pair of longitudinally spaced apart upright support portions along a single rocker axis;

a rocker plate supported by the frame and rockably mounted between the upright support portions and spaced above said base plate for rocking movement about the rocker axis and having an upper plate surface for supporting the boot and a lower surface;

a resilient rocker regulator means snugly fitted between, and in constant engagement with, the lower surface of the rocker plate and the mounting frame for resisting rocking movement of the rocker plate in both directions about the rocker axis.

18. A binding for attaching a boot to a snowboard, comprising:

a pair of binding units attached to the snowboard, the pair of binding units including front and rear binding units for respectively supporting the toe and the heel of the boot, the pair of binding units having a neutral position to normally support the boot in a plane parallel with the snowboard; and each binding unit including a frame adapted for attachment to the snowboard, a rocker plate rockably attached to the frame and adapted for supporting the boot and rocking about a single rocker axis, and a resilient rocker regulator means snugly fitted between, and in constant engagement with, a lower surface of the rocker plate and the frame for resiliently urging the rocked rocker plate to the neutral position; and the single rocker axes of the pair of binding units being coincident and extending generally lengthwise of the boot;

such that a lateral load on the boot rocks the boot sideways out of the neutral position about the rocker axes, and the rocker regulator means resiliently urges the boot back to the neutral position in opposition to the lateral load.

19. The binding of claim 18, wherein both bindings of the binding pair rock simultaneously when a lateral load is applied to the snowboard boot.

20. The binding of claim 19, wherein two pairs of bindings are mounted to the snowboard to support a pair of boots, the pairs of bindings rocking independently as lateral loads are applied to each boot.

21. The binding of claim 18, wherein the boot longitudinal axis is above the aligned rocker axes.

* * * * *